United States Patent [19]

Merrifield

[11] 4,271,609

[45] Jun. 9, 1981

[54] SNOWSHOE

[76] Inventor: Fred C. Merrifield, 8746 Overlake Dr. W., Bellevue, Wash. 98004

[21] Appl. No.: 95,958

[22] Filed: Nov. 20, 1979

[51] Int. Cl.[3] ..... A43B 5/04

[52] U.S. Cl. ..... 36/125

[58] Field of Search ..... 36/125, 122, 123, 124

[56] References Cited

U.S. PATENT DOCUMENTS

| | | | |
|---|---|---|---|
| 2,738,596 | 3/1956 | Walsh | 36/125 |
| 2,769,250 | 11/1956 | Rinkiner | 36/125 |
| 4,085,529 | 4/1978 | Merrifield | 36/125 |
| 4,161,070 | 7/1979 | Maul | 36/125 |

*Primary Examiner*—Patrick D. Lawson

*Attorney, Agent, or Firm*—Christensen, O'Conner, Johnson & Kindness

[57] ABSTRACT

An improved snowshoe includes a rigid soleplate swingably mounted for pivotal motion about the forward edge of a rigid cross member extending transversely across and adjustably affixed to the peripheral frame of the snowshoe. A strap binding assembly is mounted to the upper surface of the soleplate to secure a wearer's boot to the soleplate. A spring assembly resiliently retains the soleplate and urges it forwardly about the forward edge of the cross member to augment the conventional action of the snowshoe in lifting the leading edge of the snowshoe upwardly with each step to thereby avoid catching of the leading edge in loose snow.

6 Claims, 6 Drawing Figures

Fig. 1.
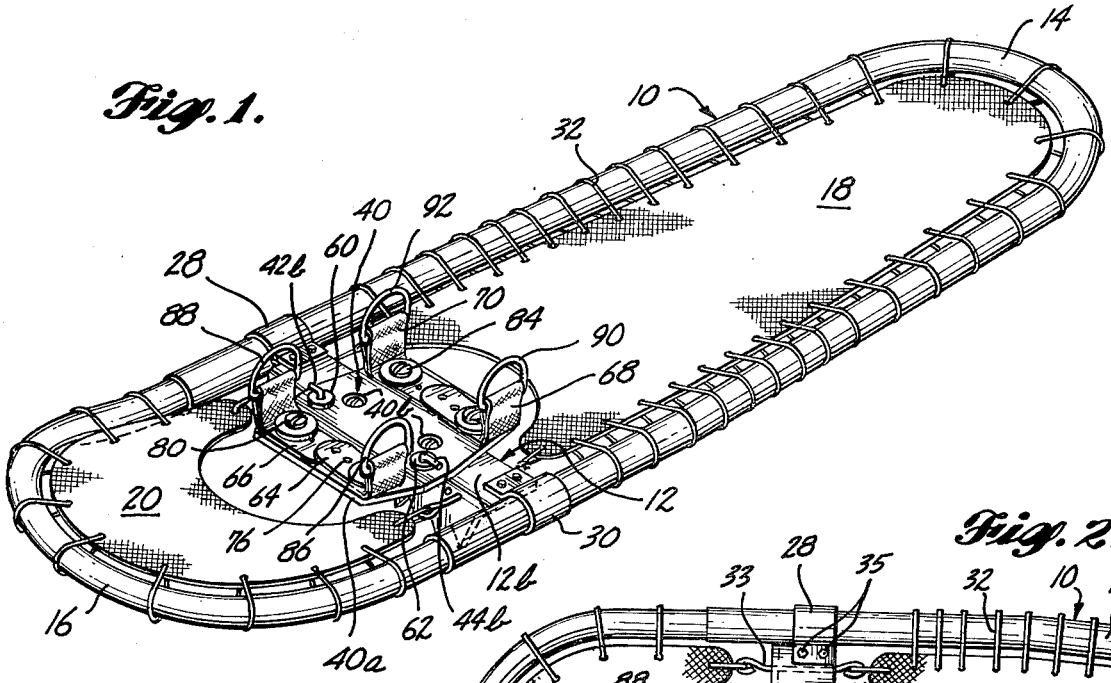
Fig. 2.
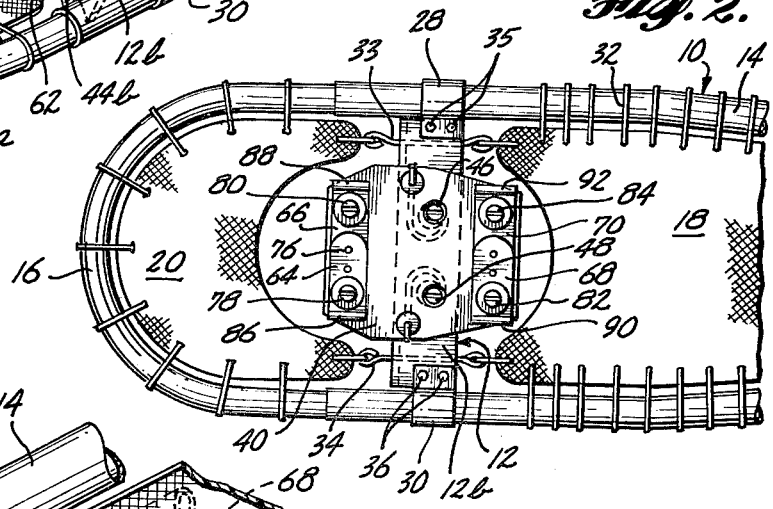
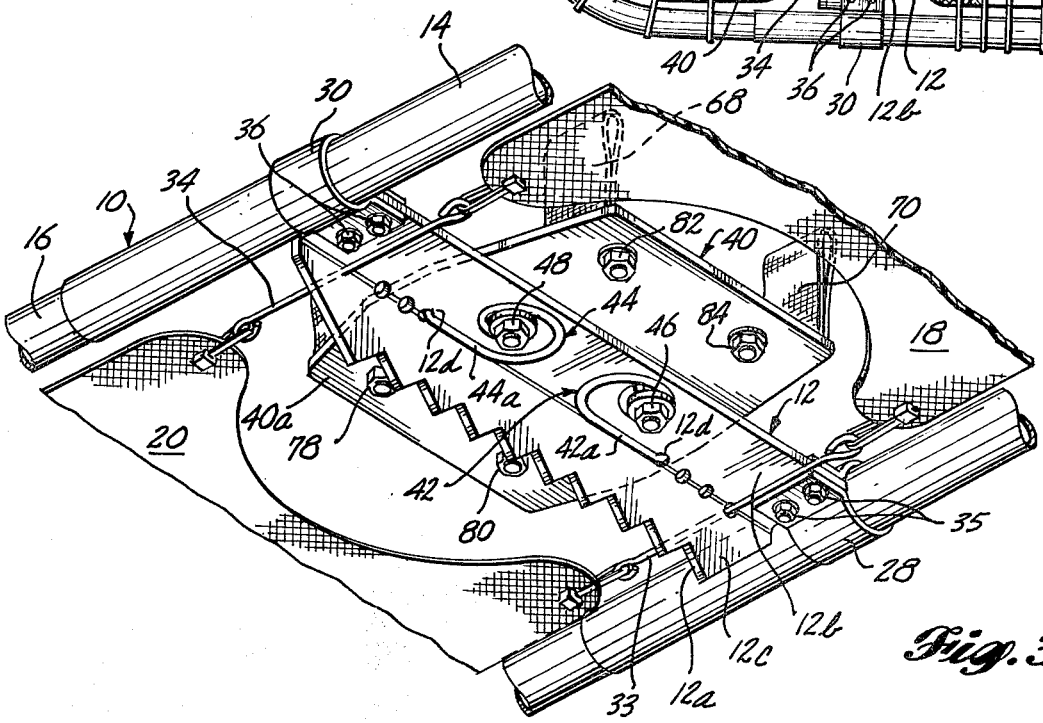
Fig. 3.

SNOWSHOE

BACKGROUND OF THE INVENTION

The present invention relates generally to snowshoes, and more particularly to improvements to the snowshoe disclosed in U.S. Pat. No. 4,085,529, issued Apr. 25, 1978 to Fred C. Merrifield, the disclosed subject matter of which is hereby incorporated by reference.

The above-referenced patent to Merrifield discloses a bearclaw-type snowshoe generally including a rigid peripheral frame and a rubberized synthetic decking stretched within the frame and attached thereto by a plurality of discrete self-locking tie members. The snowshoe further includes an adjustable, rigid cross member extending transversely between side members of the peripheral frame. The cross member is positioned within the snowshoe such that the ball of the wearer's foot bears upon the cross member when the snowshoe is properly fitted.

The aforementioned patent to Merrifield further discloses a binding assembly mounted on the cross member for securing the wearer's foot in place. Such binding includes a flexible toe piece mounted to the upper surface of the cross member. The toe piece extends forwardly from the cross member under the sole of the wearer's boot and thence upwardly and rearwardly to wrap over the toe of the wearer's boot. The binding further includes straps to hold the wearer's boot snugly engaged in the toe piece. During normal walking movement, the flexible toe piece bends over the forward edge of the cross member to allow the wearer's toe to pivot downwardly about the edge of the cross member as the wearer's heel lifts off the heel decking. The wearer's toe thus remains firmly engaged in the toe piece, with the toe piece flexing over the forward edge of the cross member with every step. Also, as the wearer's foot pivots over the edge of the cross member, the heel strap around the heel of the wearer's boot is momentarily loosened to allow for lateral movement of the heel, for example in stepping sideways onto a sloped snowbank. This feature of the prior art binding provides the advantage of firmly retaining the wearer's heel in place when the heel is in a lowered, or weight-bearing position, yet allowing the heel to move laterally at the point in each step when the heel is raised and momentarily in a non-weight-bearing position.

Despite the advantages of the prior art binding, it has been sought to improve upon certain features thereof. For example, it has been sought to provide a binding assembly that is easier to adjust in the field and which permits the snowshoe to be put on or taken off by a simple manipulation of a single buckle assembly.

Also, it has been sought to provide a snowshoe having a rigid soleplate in order that the load of the bearer's weight on the forward edge of the cross member may be distributed over a larger surface area of the sole of the wearer's boot. In the prior art snowshoe, the flexible toe piece results in the entire load of the bearer's weight being transmitted to the forward edge of the cross member at each step along the narrow, transverse strip of the wearer's boot sole in contact with the edge of the cross member. As a result, a stiff boot sole is necessary for comfort. Also, the portion of the flexible toe piece adjacent the edge of the cross member is subject to wear and premature failure due to the constant flexing of the toe piece and the abrasive action of the boot sole on the toe piece along the edge of the cross member.

Also, it has been recognized that the use of the snowshoe would be slightly facilitated if such a soleplate could be spring-biased so as to augment the normal action of the snowshoe in lifting the leading edge of the snowshoe with each step to avoid catching it in loose snow. Such a spring-biased action would allow the wearer to walk in a more normal manner without tripping or catching the snowshoe in deep snow.

Acordingly, it is an object of the present invention to provide a snowshoe having an improved binding. Specifically, it is an object to provide a snowshoe having a binding that is adjustable to accommodate boots of various sizes and shapes, yet which is easily adjustable in the field and which allows the snowshoe to be put on or taken off by a simple manipulation of a single buckle assembly.

It is also an object of the present invention to provide a snowshoe having a rigid soleplate swingably mounted to a cross member of the snowshoe frame for pivotal motion about the forward edge of the cross member with each step.

It is a further object of the present invention to provide a snowshoe having a soleplate swingably mounted to a cross member and spring-biased such that the soleplate is urged toward a forwardly tilted position with respect to the cross member to thereby augment the normal action of the snowshoe in lifting the leading edge upwardly with each step.

SUMMARY OF THE INVENTION

In accordance with the present invention, an improved snowshoe includes a rigid soleplate swingably mounted to the upper surface of a rigid cross member of a snowshoe frame and spring-biased such that the soleplate is urged toward a forwardly tilting position. In the preferred embodiment a pair of coil springs are secured to the underside of the cross member. The outer ends of the springs protrude upwardly and forwardly through apertures in the forward, upper corner of the cross member. The springs protrude from the apertures through cooperable holes in the soleplate and retentively engage the soleplate against the edge of the cross member. Thus engaged, the soleplate is free to pivot through a limited range of motion from a horizontal position flush against the top surface of the cross member to a forwardly tilted position wherein the soleplate is disposed forwardly at an angle of approximately 60° with respect to the horizontal upper surface of the cross member. As a result of the force exerted by the springs, the soleplate tends to pivot forwardly on the snowshoe, yet is also limited from further tilting by the retaining springs.

In another aspect of the present invention, the snowshoe includes a strap-type binding mounted to the upper surface of the soleplate. The binding includes fore and aft pairs of sole straps mounted transversely across the fore and aft ends of the soleplate. The sole straps each wrap upwardly around the sides of the sole of the wearer's boot and terminate in loops. Four D-rings are engaged in the terminal loops of the sole straps. The D-rings engage and retain a heel strap and a toe strap. Additionally, the pairs of D-rings on opposite sides of the binding are connected by short connecting straps.

The heel strap, toe strap, sole straps and connecting straps are each independently adjustable. The heel strap extends rearwardly around the heel of the wearer's boot and is engaged to the two D-rings on the opposite sides of the wearer's boot. The heel strap is adjustable in length by means of a conventional buckle assembly.

The left- and right-hand connecting straps connect the pairs of D-rings on the left- and right-hand sides of the wearer's boot, respectively. The connecting straps are also adjustable in length by a conventional buckle.

In the preferred embodiment, the toe strap is a continuous strap that is engaged at one end to the D-ring located outwardly and forwardly with respect to the wearer's boot (being the left-hand, forward D-ring on the left snowshoe and the right-hand forward D-ring on the right snowshoe). From its terminal end at the outer, forward D-ring, the toe strap extends around the forward edge of the boot sole, through the inside, forward D-ring and back across the toe of the boot to the outer, forward D-ring, thence through the outer, forward D-ring and diagonally over the top of the wearer's boot to the inside, rear D-ring, and thence through the inside, rear D-ring and again over the arch of the wearer's boot to terminate at a buckle assembly attached to the outside, rear D-ring. The buckle assembly on the outside of the arch of the wearer's boot permits adjustment of the tension in the toe strap and is normally the only buckle assembly that need be manipulated to put the snowshoe on or take it off.

In another aspect of the invention, the sole straps are adjustable to accommodate the particular size and shape of the sole of the wearer's boot by means oer's boot permits adjustment of the tension in the toe strap and is normally the only buckle assembly that need be manipulated to put the snowshoe on or take it off.

In another aspect of the invention, the sole straps are adjustable to accommodate the particular size and shape of the sole of the wearer's boot by means of a plurality of apertures in the ends of the sole straps, and fasteners which pass through selected apertures to secure the sole straps to the soleplate. Such adjustment is made only infrequently, as when new boots are fitted to the snowshoe binding for the first time, so that the fasteners normally consist of conventional nut-and-bolt assemblies which may be securely engaged for longterm use.

BRIEF DESCRIPTION OF THE DRAWINGS

A better understanding of the present invention can be derived by reading the ensuring specification in conjunction with the accompanying drawings wherein:

FIG. 1 is an isometric view of the snowshoe looking rearwardly along the shoe from the top, and showing the soleplate and sole straps, but without the heel strap, toe strap or connecting straps.

FIG. 2 is a top view of the snowshoe illustrated in FIG. 1.

FIG. 3 is an isometric bottom view of the snowshoe of FIG. 1 looking forwardly from underneath the snowshoe.

DETAILED DESCRIPTION OF THE PREFERRED EMBODIMENT

Figure 4:
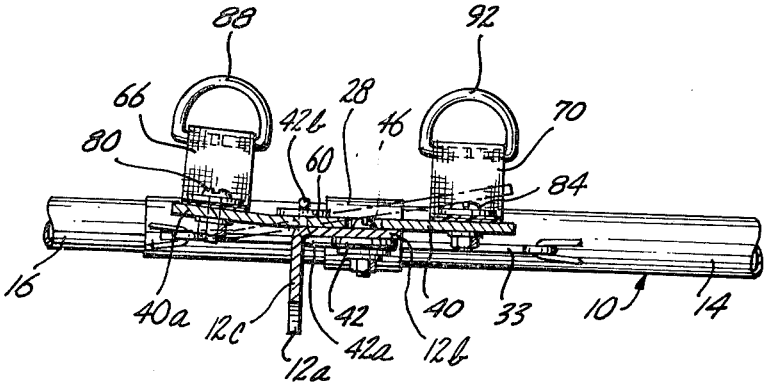
FIG. 4 is a side view in partial cross section of a portion of the snowshoe illustrated in FIG. 1.

Referring to FIGS. 1 and 2, the preferred embodiment of the snowshoe includes a rigid frame consisting of a peripheral frame member, generally designated 10, and a rigid, transverse cross member 12. The peripheral frame member 10 includes a tubular heel member 14 and a tubular toe member 16. The tubular side portions of the toe member 16 of the peripheral frame member 10 telescope axially within the slightly larger tubular side portions of the heel member 14. Rather than a conventional webbed decking, the snowshoe includes a resin-impregnated fabric decking. The decking is divided into a heel decking 18 sized to fit within the heel member 14 of the peripheral frame member 10 and a toe decking 20 sized to fit within the toe member 16 of the peripheral frame member 10.

The heel decking 18 and the toe decking 20 are lashed to the peripheral frame member 10 by a plurality of discrete tie members 32 which, in the preferred embodiment, are loops of flexible polymeric material that wrap around the outer edges of the frame member 10, are threaded through slots in the peripheral portions of the decking and back toward the frame so as to form a continuous, closed loop. The forwardmost ties 32 of the heel decking 18 and the rearwardmost ties 32 of the toe decking 20 are connected by wire fasteners 33 and 34. The individual ties 32, as opposed to the lacing or webbing of traditional snowshoes, provide the advantages of ease of assembly, durability, failure resistance, ease of repair of the snowshoe and protection of the integrity of the decking.

The cross member 12 is positioned to underlie the ball of the wearer's foot. More specifically, the cross member 12 is positioned in the space between the forward end of the heel decking 18 and the aft end of the toe decking 20. The cross member 12 is adjustably affixed to the side portions of the peripheral frame member 10 by split collar clamps 28 and 30. The cross member 12 is of the form of an aluminum angle beam having a toothed, or serrated, lower edge **12*a*, best seen in FIG. 3. The toothed edge 12*a* provides traction, especially when the snowshoe is being used to climb a grade. The cross member 12 further includes a substantially planar upper plate portion 12*b* that generally lies in the plane of the snowshoe, and a downwardly turned, substantially vertical integral plate portion 12*c* that depends from the rounded forward edge of the upper plate portion 12*b* and terminates in the lower serrated edge 12*a*. The upper plate portion 12*b* is secured to the tubular side portions of the heel member 14 by the split collar clamps 28 and 30. The clamps 28 and 30 include integral, inwardly extending, parallel flanges positioned on each side of the collar split which enclose the opposite ends of the upper plate portion 12*b*. The flanges are clamped in place to the upper plate portion 12*b* by nut-and-bolt assemblies 35 and 36**. As thus far described, the snowshoe is substantially as disclosed in the aforementioned U.S. Pat. No. 4,085,529 to Merrifield. Additional details regarding the fabrication, construction and materials employed in the snowshoe thus far described can be found in said patent.

A rigid aluminum soleplate 40 is swingably mounted to the cross member 12 by coil springs 42 and 44. The springs 42 and 44 firmly retain the soleplate 40 and yet also permit the soleplate 40 to pivot about the forward, upper edge of the cross member 12 along which the upper plate portion **12*b* and the lower plate portion 12*c* join. The soleplate 40 is generally flat, except for a forward portion 40*a* bent upward slightly to conform more closely with the sole of the wearer's boot. The soleplate is generally rectangular in shape, being of a maximum width at its midsection where it bears upon the forward edge of the cross member 12, and with the side edges being tapered slightly both forwardly and rearwardly therefrom to the fore and aft end edges. The lengthwise dimension of the soleplate 40** is such as to extend approximately from the toe of the wearer's boot to the forward end of the arch of the wearer's boot.

Springs 42 and 44 are made of heavy gauge steel wire and each have the configuration of a coil spring having a straight portion with two right-angle bends at its outer end. The inner, coiled ends of the springs 42 and 44 are secured to the underside of the upper plate portion **12*b* of the cross member 12 by means of nut-and-bolt fasteners 46 and 48, respectively. The soleplate 40 includes a pair of holes 40*b* to accommodate the heads of the fasteners 46 and 48 where they rise above the surface of upper plate portion 12*b*. From the fasteners 46 and 48, the springs 42 and 44 coil outwardly in opposite rotational directions to straight portion 42*a* and 44*a* running outwardly along the inside corner where the upper plate portion 12*b* and the lower plate portion 12*c* adjoin. At the end of the straight portions 42*a* and 44*a*, the springs are bent at a right angle to pass diagonally outwardly through apertures 12*d* in the forward corner of the cross member 12 and thence through cooperably aligned holes in the soleplate 40. The outer ends 42*b* and 44*b* of the springs 42 and 44 thence bend outwardly at a right angle. Nylon washers 60 and 62 containing a molybdenum disulfide lubricant are interposed between the terminal right-angle ends 42*b* and 44*c* of the springs 42 and 44, respectively, and the upper surface of the soleplate 40. The nylon washers 60 and 62 provide wear resistance and resiliency to the points at which the springs 42 and 44 retain the soleplate 40** in position.

In operation, the soleplate is free to pivot from a substantially horizontal position wherein the main portion of the soleplate 40 is flush against the upper plate portion **12*b* of the cross member 12 to a forwardly tilted position wherein the main portion of the soleplate 40 is disposed at an angle of approximately 60° with respect to the upper surface of the cross member 12. In FIG. 4 the soleplate 40 is shown in phantom as being tilted forward on the cross member 12. The springs 42 and 44 firmly retain the soleplate against the forward edge of the cross member 12 during pivoting of the soleplate in normal walking movement to provide a smooth, continuous pivotal action. The springs 42 and 44 further operate to limit the forward tilting motion of the soleplate 40**.

Figure 5:
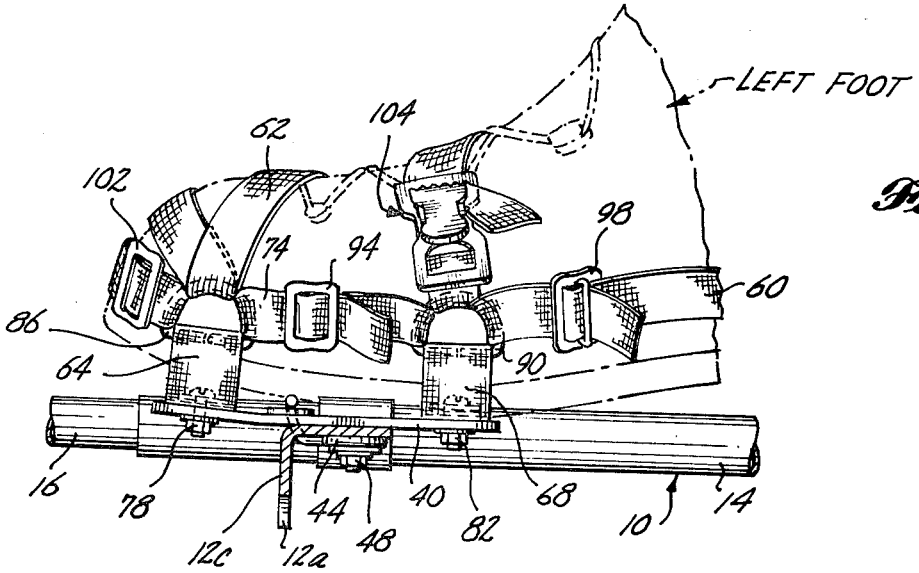
FIG. 5 is a side view in partial cross section showing the snowshoe binding of the present invention securing a wearer's boot to the soleplate.
Figure 6:
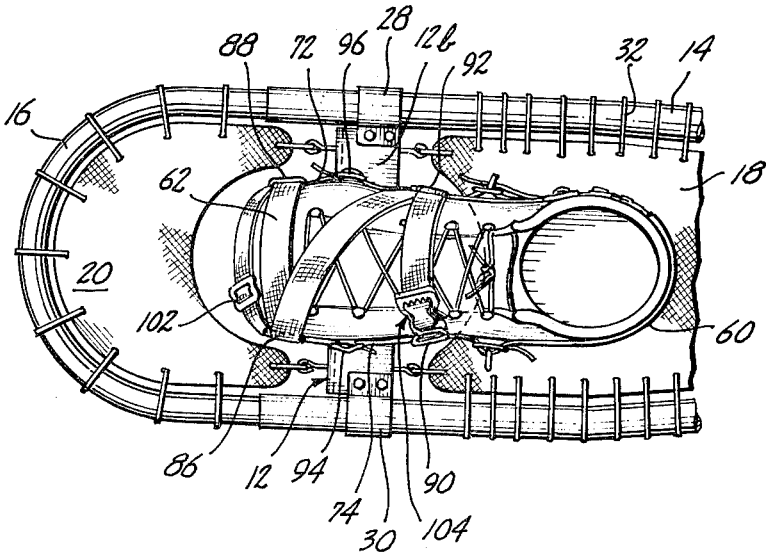
FIG. 6 is a top view of the binding of the present invention engaging a wearer's boot.

Referring additionally to FIGS. 4 through 6, the snowshoe includes a strap binding assembly mounted to the top of the soleplate 40. It will be noted at this point that FIGS. 5 and 6 illustrate a left-hand boot mounted to the snowshoe. Accordingly, the various features of the binding assembly are described below by reference to the inner and outer sides (left-hand and right-hand sides, respectively) of the boot.

Referring to FIGS. 5 and 6, the strap binding assembly includes generally a heel strap 60 that wraps around the heel of the wearer's boot, a toe strap 62 that wraps in several passes over the toe and arch of the wearer's boot, four sole straps 64, 66, 68 and 70 extending outwardly and upwardly from the soleplate around the edge of the sole of the wearer's boot, and inner and outer connecting straps 72 and 74, respectively.

Referring to FIGS. 1 through 4, each of the four sole straps 64 through 70 consists of a single strip of resin-impregnated fabric having a plurality of apertures 76 in each end. Each strip of resin-impregnated fabric is looped back upon itself and secured to the soleplate 40 by means of conventional nut-and-bolt assemblies 78, 80, 82 and 84 passing through selected apertures of each end of the respective sole straps 64, 66, 68 and 70. Each nut-and-bolt assembly includes a large washer to distribute the stress evenly on the sole strap fabric. Each sole strap thus forms a loop which is adjustable in length by selecting an appropriate choice of apertures through which the nut-and-bolt fastening assemblies 78 through 82 are passed.

Enclosed by the loops formed by each of the sole straps 64, 66, 68 and 70 are D-rings 86, 88, 90 and 92, respectively. The outer connecting strap 74 on the left-hand side of the binding connects the forward and rear outer D-rings 86 and 90 and is adjustable by means of a conventional buckle 94. Likewise, the inner connecting strap 72 connects the fore and aft inner D-rings 88 and 92 and is adjustable in length by a conventional buckle 96.

The heel strap 60 is secured to the rear, outer D-ring 90 by means of a loop formed in one end of the heel strap 60 by a conventional buckle 98. The heel strap 60 wraps around the heel of the wearer's boot and terminates at a conventional buckle assembly 100 which adjustably secures the strap 60 to the inner, rear D-ring 92. The buckle assembly 100 permits selective adjustment of the tension of the heel strap 60.

As earlier mentioned, the toe strap 62 wraps in several passes over the toe and arch of the wearer's boot. One end of the toe strap 62 is engaged with the outer, forward D-ring 86 by means of a loop formed in the end of the strap 62 with a conventional buckle 102. From D-ring 86, the toe strap 62 passes around the forward edge of the sole of the boot and through the inner, forward D-ring 88. From the inner, forward D-ring 88, the toe strap passes across the toe of the boot and back through D-ring 86, from whence it passes diagonally over the toe of the boot to the rear, inner D-ring 90. The strap 62 thence passes through the D-ring 90 and back over the arch of the wearer's boot to terminate in a buckle assembly 104 secured to the outer, rear D-ring 90. The buckle assembly 104 permits adjustment of the tension of the toe strap 62.

To put the snowshoe on, a user will initially adjust the dimensions of the sole straps 64 through 70 and the connecting straps 72 and 74 to fit his or her boots. These adjustments are ordinarily necessary only when fitting a pair of boots to the snowshoes for the first time. Hence, they are made infrequently and rarely need to be made in the field. Next, with the toe strap 62 and heel strap 60 in place, the wearer will adjust the tension of the heel strap 60 to give a proper fit. Once the heel strap 60 is adjusted, only the toe strap 62 need be engaged each time the snowshoe is put on. Likewise, only the toe strap 62 need be loosened to take the snowshoe off.

During normal use of the snowshoe, the springs 42 and 44 act to lightly urge the soleplate 40 toward a forwardly tilted position. In a rest, or standing position, the weight of the snowshoe wearer is much greater than the force exerted by the springs 42 and 44, with the result that the soleplate 40 rests flushly on the top of the cross member 12. During normal walking motion, the springs 42 and 44 lightly assist the wearer in the lifting of his or her heel at each step. Also, the spring-biased soleplate 40 augments the normal action of the snowshoe in causing the snowshoe to tilt rearwardly when the wearer lifts his or her foot with each step. Such action is ordinarily built in to a conventional snowshoe by way of the binding being positioned forward of the center of gravity of the snowshoe. As a result, the leading edge of the snowshoe is automatically lifted upwardly with each step to thereby prevent the leading edge from catching in deep powder snow. Conversely, the trailing edge of the snowshoe is urged downwardly at each step and thereby keeps the center of gravity of the snowshoe as low as possible. As a result, walking in the snowshoe of the present invention is easier and more comfortable than walking in prior art snowshoes because the tendency of the leading edge to catch in loose snow is further reduced and because the center of gravity is nevertheless maintained as low as possible to minimize the amount of work expended at each step.

Although the present invention is described and illustrated herein by reference to a preferred embodiment, it will be understood that various alterations, modifications and substitutions which may be apparent to one skilled in the art may be made without departing from the essential spirit of the invention. Accordingly, the scope of the present invention is defined by the following claims.

The embodiments of the invention in which an exclusive property or privilege is claimed are defined as follows:

1. In a snowshoe having a rigid frame, said frame including a peripheral frame member and a rigid cross member, said cross member extending transversely across said snowshoe between side portions of said peripheral frame member and being positioned to underlie the ball of the wearer's foot, decking means secured to and enclosed by said peripheral frame member, said cross member including an upper plate portion having a substantially planar upper surface and an integral, downwardly turned portion depending from the forward edge of said upper plate portion, the improvement comprising a soleplate swingably mounted to said upper plate portion of said cross member for swinging movement between a substantially horizontal position wherein said soleplate bears flushly on said upper surface of said upper plate portion of said cross member and a forwardly tilted position wherein said soleplate is tilted forwardly about said forward edge of said cross member and disposed at an angle with respect to the upper surface thereof, spring means operating to urge said soleplate toward said forwardly tilted position, and strap binding means mounted on the upper surface of said soleplate for securing a wearer's boot to said soleplate.

2. The improvement defined in claim 1 wherein said rigid soleplate is swingably attached to said upper plate portion of said cross member for swinging motion about said forward edge of said upper plate portion by a pair of springs extending through spaced holes in said forward edge of said cross member and through cooperably aligned holes through said soleplate, said springs including means at their ends protruding through said holes in said soleplate for retaining said soleplate firmly against said forward edge of said cross member and means at their opposite ends retaining said springs to the lower surface of said cross member.

3. The improvement defined in claim 2 wherein said soleplate is swingably attached to said cross member by first and second coil springs, said springs each having an inner, coiled end and an outer end, said inner coiled ends of said first and second springs each being secured to the lower surface of said upper plate portion of said cross member, said outer ends of said first and second springs protruding respectively through first and second holes spaced along said forward edge of said upper plate portion of said cross member and protruding therefrom through cooperably aligned first and second holes through said soleplate, and means at said outer ends of said first and second springs for retaining said soleplate firmly against said forward edge of said cross member.

4. The improvement defined in claim 3 wherein said means at said outer ends of said first and second springs for retaining said soleplate against said forward edge of said cross member comprise first and second nylon washers engaged by said springs between said outer ends of said springs and said holes through said soleplate, said outer ends of said springs being bent outwardly to retain said nylon washers firmly against said soleplate.

5. The improvement defined in claim 4 wherein said strap binding means includes:

forward and rear pairs of sole straps mounted to said soleplate, said forward pair of sole straps including an inner, forward sole strap and an outer, forward sole strap, said rear pair of sole straps including an inner, rear sole strap and an outer, rear sole strap, each of said sole straps including a plurality of apertures at each end thereof, each of said sole straps being fastened to said soleplate by a fastener passing through a selected aperture of each end of said sole strap to thereby form a loop of variable length by means of said sole strap, each of said sole straps having a D-ring engaged in said loop of said sole strap;

inner and outer connecting straps, said inner connecting strap connecting said D-rings of said inner, forward sole strap and said inner, rear sole strap, said outer connecting strap connecting said D-rings of said outer, forward strap and said outer, rear sole strap, said inner and outer connecting straps being selectively adjustable in length;

a heel strap connecting said D-rings of said inner and outer rear sole straps, said heel strap being adjustable in length and positioned to pass around and firmly engage the heel of the wearer's boot; and an adjustable toe strap passing through and connecting said D-rings of said sole straps for securing the toe of the wearer's boot to said soleplate.

6. The improvement defined in claim 5 wherein said toe strap includes first and second ends, said first end being secured to said D-ring of said outer, forward sole strap, said toe strap passing from said first end at said outer, forward D-ring through said inner, forward D-ring, thence back through said outer, forward D-ring and diagonally over the toe of the wearer's boot to said inner, rear D-ring and thence through said inner, rear D-ring and over the arch of the wearer's boot to terminate at a buckle means secured to said outer, rear D-ring, said buckle means enabling selective adjustment of the tension of said toe strap.

* * * * *

UNITED STATES PATENT AND TRADEMARK OFFICE

CERTIFICATE OF CORRECTION

PATENT NO. : 4,271,609

DATED : June 9, 1981

INVENTOR(S) : Fred C. Merrifield

It is certified that error appears in the above-identified patent and that said Letters Patent are hereby corrected as shown below:

Column 3, lines 27 - 32: Delete paragraph.

Signed and Sealed this

*Eighth* Day of *September 1981*

[SEAL]

*Attest:*

GERALD J. MOSSINGHOFF

*Attesting Officer*

*Commissioner of Patents and Trademarks*